United States Patent [19]

Palisek

[11] 4,256,931

[45] Mar. 17, 1981

[54] MULTIPLE DOME SWITCH ASSEMBLY HAVING PIVOTABLE COMMON ACTUATOR

[75] Inventor: William F. Palisek, Mundelein, Ill.

[73] Assignee: Interstate Industries, Inc., Mundelein, Ill.

[21] Appl. No.: 69,904

[22] Filed: Aug. 27, 1979

[51] Int. Cl.[3] ..... H01H 13/70; H01H 25/00

[52] U.S. Cl. ..... 200/5 A; 200/6 A; 200/153 K

[58] Field of Search ..... 200/5 R, 5 A, 6 A, 159 B, 200/153 K, 339, 17 R, 159; 74/471 XY; 400/485

[56] References Cited

U.S. PATENT DOCUMENTS

| | | | |
|---|---|---|---|
| 2,507,016 | 5/1950 | Hesh | 200/6 A |
| 2,863,010 | 12/1958 | Riedl | 200/5 R |
| 3,005,055 | 10/1961 | Mattke | 200/6 A X |
| 3,033,946 | 8/1962 | Meyer et al. | 200/6 A |
| 3,996,427 | 12/1976 | Kaminski | 200/159 B X |
| 4,029,915 | 6/1977 | Ojima | 200/5 A |
| 4,034,761 | 7/1977 | Prater et al. | 200/153 K X |
| 4,124,787 | 11/1978 | Aamoth et al. | 200/17 R |

OTHER PUBLICATIONS

Bennett, Jr., W. A. et al., IBM Tech. Disc. Bull., "Digital Joystick Switch", vol. 21, No. 12, May 1979; pp. 4962–4964.

McCornack, W. C., IBM Tech. Disc. Bull., "Single Keybutton Four-Way Switch", vol. 21, No. 8, Jan. 1979, p. 3261.

*Primary Examiner*—James R. Scott

*Attorney, Agent, or Firm*—Henry S. Kaplan

[57] ABSTRACT

A switching control button structure is provided for selectively actuating a plurality of resilient dome momentary contact switches. The momentary contact switches are mounted on a support surface and arranged generally about the circumference of a circle. A pivot pin extends from the center of the circle and supports a key adapted to tilt about the pivot pin. The key has wings extending over the switches and is normally upwardly biased by the switches to a neutral, non-switching position so that a switch can be selectively actuated by applying force to the key anywhere along a line extending from the center of the key through a point generally over the switch. The key has a central circular serrated region by which rapid and successive actuation of the switches can be achieved by applying forces on the serrated region in the direction of the selected switches.

6 Claims, 2 Drawing Figures

MULTIPLE DOME SWITCH ASSEMBLY HAVING PIVOTABLE COMMON ACTUATOR

DESCRIPTION

This invention relates in general to switch construction and in particular to a new and useful switch key which is especially suitable for use in electronic games.

BACKGROUND OF THE INVENTION

In some applications it is desirable to provide a manually operable device for selectively controlling a plurality of switches. Prior art devices have included center pivoting members for actuating a plurality of switches arranged in circumferential relationship to the pivot point. With some of these devices, one must actuate a particular switch by applying direct pressure on a force applying area which is located directly over the particular switch to be actuated. Further, in these prior art devices, separate springs or spring biasing means are required to maintain the pivoting member in a neutral position above the surface on which the switches are circumferentially disposed.

For example, U.S. Pat. No. 2,863,010 to Riedel is directed to an actuating means for multiple switches. Force can be applied to a pivotally mounted circular push plate in the center of the plate to actuate three switches equally spaced in a circle below the plate. The device requires the use of a separate spring mounted about the pivot pin to bias the push plate upwardly away from the switches.

The U.S. Pat. No. 4,029,915 to Ojima discloses a switch button with a separate bias spring positioned around a pivot portion and which is required to bias the button to a neutral position out of contact with the switching elements.

The U.S. Pat. No. 3,965,315 to Wuenn discloses a generally square block for actuating four switches through intermediate reciprocating contact rods. Four separate springs are mounted on the reciprocating contact rods above each of the switches to bias the button upwardly to the neutral non-switching position.

Other spring biased switch buttons are disclosed in the U.S. Pat. Nos. 3,633,724 (to Samuel), 3,005,055 (to Mattke), and 3,399,287 (to Euler).

It would be desirable to provide a tilting switch mechanism for multiple switches wherein an operating button or key is biased to a neutral position without separate springs. Further it would be advantageous to bias the key to the neutral position with means integral with the switch elements. Also, it would be beneficial to provide such a mechanism wherein a single switch can be actuated independently of other switches by applying force to a region at the periphery of the key. Further, it would be desirable to have a central force applying area on the key to permit an operator to easily and rapidly actuate any one of the switches without having to move his finger or thumb to a peripheral force applying area.

SUMMARY OF THE INVENTION

In accordance with a preferred embodiment of the present invention, a plurality of resilient dome momentary contact switches are mounted on a support surface equally spaced apart in a circle. A button or key is pivotally mounted above the support surface. The key has a central force applying region and also has outwardly extending wings which each carry a switch engaging member disposed above a single switch. The resilient dome switches upwardly bias the switch engaging members so that the key is normally biased to a neutral non-switching position generally parallel to the support surface. Each switch can be actuated by applying force to the key anywhere along a radial line extending from the center of the key through a point over the selected switch. Thus each switch can be actuated either by applying force to the key directly over the switch or by applying force in the central region of the switch in the direction of the switch desired to be actuated.

The central force applying region is preferably circular and cross-hatched or serrated so that an operator can actuate any one of the switches with his finger or thumb remaining positioned on this central region.

In its preferred embodiment, the key is cruciform in shape, so as to more easily identify peripheral force applying regions over the respective switches beneath them.

The novel switching control button structure of the present invention is thus seen to provide an integral bias means in the form of resilient dome momentary contact switches which normally maintain the button in a neutral non-switching position. This eliminates the need for more complex spring mechanisms.

The present invention also provides more than one force-applying area for selectively actuating each of the contact switches. Also, the centrally disposed force-applying area permits selective, independent actuation of each of the switches in rapid succession.

Numerous other advantages and features of the present invention will become readily apparent from the following detailed description of the invention and one embodiment thereof, from the claims and from the accompanying drawings.

DETAILED DESCRIPTION OF THE PREFERRED EMBODIMENT

Figure 1:
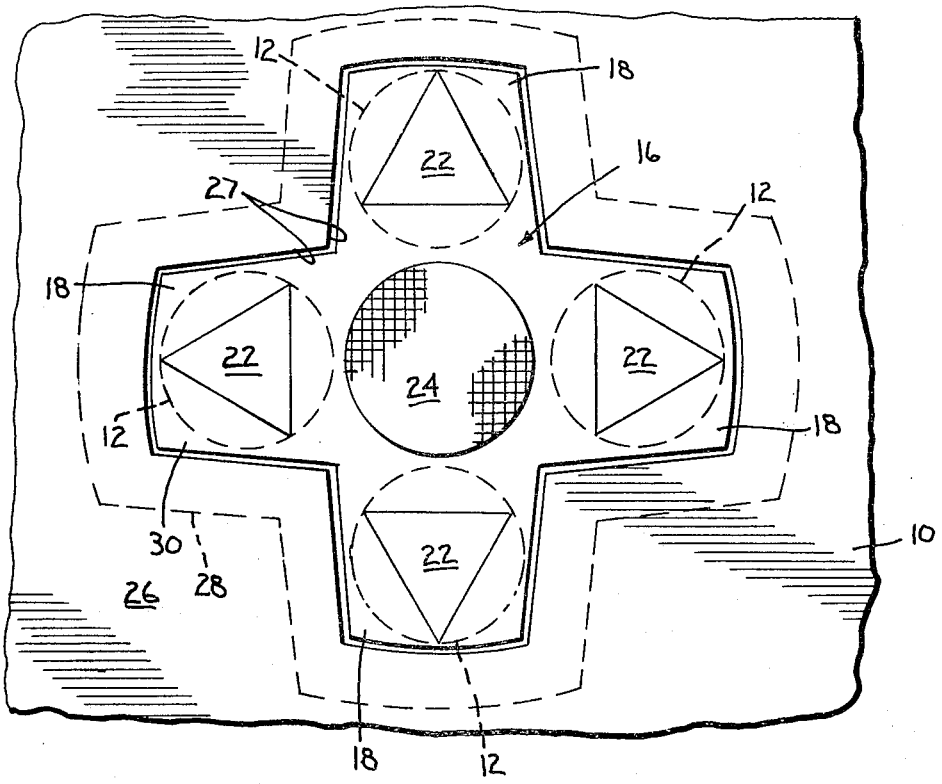
FIG. 1 is a top plan view of the switching control button of the present invention.

While this invention is susceptible of embodiment in many different forms, there is shown in the drawings and will herein be described in detail one specific embodiment, with the understanding that the present disclosure is to be considered as an exemplification of the principles of the invention is not intended to limit the invention to the embodiment illustrated.

Figure 2:
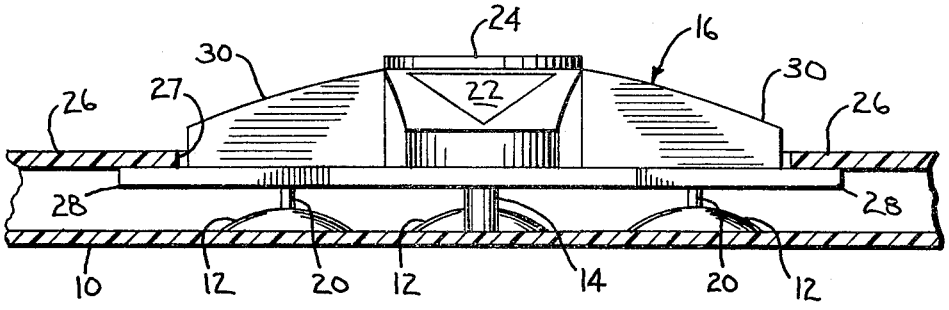
FIG. 2 is a side view of the switching control button of the present invention shown in partial cross-section.

Referring now to the drawing, FIG. 2 shows a support surface 10 upon which is mounted a plurality of resilient dome momentary contact switches 12 arranged preferably in circumferential fashion. The resilient dome switches are well known to those skilled in the art, and their construction and design do not consitute part of the present invention. Such switches are described, for example, in the U.S. Pat. Nos. 3,988,551 (to Larson), 3,996,429 (to Chu et al.), 4,029,916 (to Chu), 4,071,718 (to Harden), 4,084,071 (to Smith), 4,104,702 (to Armstrong) and 4,123,627 (to Boulanger et al.).

For the purposes of describing the present invention, it need merely be noted that the switch's upper region presents a hemispherical dome or shell in its normal undeformed condition. When one wishes to actuate the switch to close a set of contacts, one merely applies pressure to the top region of the shell or dome to deform it until the electrically conductive inner dome surface makes contact with another electrically conductive member beneath the dome. Upon releasing the downward pressure electrical contact ceases, and the switch automatically returns to its original undeformed condition. As will be seen, such a switch employed in a novel manner in the present invention performs a mechanical biasing function.

In FIG. 2, a pivot support member or pivot pin 14 is located on the support surface 10 in the center of the circle formed by the momentary contact switches 12 and extends upwardly away from the support surface 10. A key 16 is pivotally mounted upon the pivot support member 14 at the key center, so that the key can be pivoted or tilted about the member 14. In its preferred configuration, key 16 is cruciform in shape, and defines four outwardly extending key wings 18. Each wing 18 is associated with and located above one of the contact switches 12. Each key wing 18 carries a downwardly projecting switch engaging means or member 20 which contacts the dome of the associated switch 12 directly beneath it. The domes of contact switches 12 support the switch engaging members 20, and hence the key 16, in a neutral position so long as no external force is applied to the top surface of the key 16.

Disposed on the top surface of the key 16 are four triangular shaped force applying regions 22 located above each of the contact switches 12. Also disposed on the top surface of key 16, at its center, is a generally circular serrated or cross-hatched surface 24, to aid in fast switching operation, as will be explained below.

When it is desired to actuate one of the contact switches 12, a downward force can be applied to the triangular force applying area 22 directly above it on the key. This will cause the key 16 to pivot about the pivot support member 14 and cause the dome of contact switch 12 to deform and actuate a switching function.

The contact switch 12 can be actuated also by applying a downward force on the circular serrated surface 24, slightly off center, in the direction of one of the key wings 18 associated with switch desired to be actuated. Thus, the operator need merely place a finger or thumb on the circular serrated surface 24 and, with minimal horizontal and vertical movement, the operator can selectively actuate any one of the switches by applying force in the direction of the selected switch. It can thus be appreciated that for normal speed actuation of one of the contact switches 12, one can apply a downward force to the triangular force applying area 22 directly above a contact switch associated therewith, and that for fast speed switch actuation, one can place his finger or thumb on the circular serrated surface 24 and apply a force in the direction of the switch to be actuated. Cross-hatch ridges, lines or serrations can be formed on surface region 24 to increase the friction between the finger or thumb and the key 16 and thus reduce the possibility of slipping.

It is to be noted that the operator may also actuate a switch by applying downward pressure on the key anywhere generally along a radius line originating from the center of the key 16 and passing through the triangular force applying area 22 associated with the contact switch 12 desired to be actuated.

Once downward pressure is released, the resilient dome momentary contact switch 12 automatically returns to its undeformed condition and biases or urges the switch engaging member 20 upwardly whereupon key 16 assumes a level position relative to support surface 10 corresponding to a neutral, non-switching state.

The novel switching control button of the present invention is not limited to application on a horizontal surface and can work in non-horizontal orientations, including vertical, since the biasing function of each contact switch 12 will occur regardless of its orientation.

Also provided in the present invention is a top surface restraining member 26 which defines a generally cruciform-shaped opening 27 having generally the same configuration as the cruciform key 16. In the preferred embodiment, the cruciform-shaped key has an outwardly extending base 28 and a top key portion or surface 30. The cross-sectional area at the key base 28 is larger than the cross-sectional area of the top portion 30 of the key. The opening 27 defined by the top surface restraining member 26 is larger than the cross-sectional area of the top portion 30 of the key but smaller than the cross-sectional area at the base 28 of the key. Thus when the key 16 is received by the cruciform opening 27 of the key restraining member 26, the cruciform key 16 is prevented from being rotated with respect to the vertical axis of pivot support member 14 and is prevented from being removed from the opening 27. In this manner, the key is retained with each switch engaging member 20 generally aligned over its associated switch 12.

Preferably, contact switches 12 and their associated switch engaging members 20 are arranged generally equidistantly in a circle. The support surface 10 can be a printed circuit board which can provide printed leads to contact switches 12.

The switching control button of the present invention is particularly well suited for use with electronic games where fast switching action of a number of switches is desired to move a player or playing piece on a two-dimensional surface or display. When used as such, the triangles 22 could represent the direction of the desired movement of a playing piece on the display if the switches 12 are appropriately connected to means to move the playing piece on the display.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A switch assembly comprising:

a support surface;

a plurality of resilient dome momentary contact switches mounted on the support surface and arranged generally about the circumference of a circle;

a key, and means for pivotally supporting said key above said support surface from a central portion of said circle and for maintaining the key centrally located during pivoting, said key being supported generally at its center by said pivotally supporting means whereby said key can be pivoted about its center, said key having force applying regions extending radially outwardly from its center and over an associated switch; and a plurality of switch engaging members located on said key force applying portions, each switch engaging member extending over an associated switch in contact therewith, and said switches being disposed in force equalizing relationship with respect to said switch engaging members and each switch engaging member being normally biased to a neutral position by the resilient dome of the associated switch whereby, when force is applied to a force applying region of said key anywhere along a radial line extending from the center of the key through a point generally over a switch, the key pivots and carries a switch engaging member from its neutral position to deform the resilient dome of the associated switch to actuate that switch, and, when the force is removed, that switch dome assumes its normal undeformed condition to move the switch engaging member back to its neutral position.

2. The switch assembly of claim 1 wherein means is provided for preventing the key from rotating about its center.

3. A switch assembly comprising:

a support surface;

a plurality of resilient dome momentary contact switches mounted on the support surface and arranged generally about the circumference of a circle;

a pivot support pin located on and extending from the support surface generally at the center of the circle; and a key defining a plurality of wings, each said wing having a force applying region adapted to receive a force applied thereto by a user, each of said wings extending radially outwardly from its center and over an associated switch, said key being supported generally at its center by said pivot support pin whereby the key can tilt about its center and said key having means for maintaining the key at its center on said pin during tilting, said key including a switch engaging member extending downwardly from each said wing, each switch engaging member being disposed over and in contact with an associated switch, and said switches being disposed in force equalizing relationship with respect to said switch engaging members and each switch engaging member being biased to a neutral position by the resilient dome of the associated switch whereby, when force is applied to a force applying region to tilt the key, a wing deforms the switch dome of the associated switch to actuate that switch and, when the downward force is removed, the switch dome of that switch assumes its normal undeformed condition to bias the key wing away from the support surface back to its neutral position.

4. A switch assembly comprising:

a support surface;

four resilient dome momentary contact switches mounted on the support surface and arranged generally equidistantly about the circumference of a circle;

a pivot support member located on the support surface generally in the center of the circle;

a key of generally cruciform shape defining four key wings disposed over said support surface and supported generally at its center by said pivot support member whereby the key can be pivoted about its center, each said wing having a force applying region adapted to receive a force applied thereto by a user, each of said wings extending radially outwardly from the key center and over an associated switch;

a top surface restraining member defining a generally cruciform shaped opening receiving the key in an orientation with each key wing located above a different switch, said top surface restraining member preventing rotation of the key about the support surface; and four switch engaging means located on said key, each said switch engaging means being located on a separate key wing over an associated single switch in contact therewith, and said switches being disposed in force equalizing relationship with respect to said switch engaging means and each switch engaging means being normally biased to a neutral position by the resilient dome of the associated switch whereby, when downward force is applied to the key anywhere along a radial line extending from the center of the key through a point generally above switch engaging means, the key pivots and carries an associated switch engaging means from its neutral position to deform the dome of the associated switch to actuate that switch, and, when the downward force is removed, that switch dome assumes its normal undeformed condition to bias the switch engaging means back to its neutral position.

5. The switch assembly of claim 4 including a generally circular serrated surface disposed generally at the center of the key for more easily permitting an operator to apply force with a finger or thumb about the center of the key and pivot the key for selectively actuating any one of the four contact switches.

6. The switch assembly of claim 4 wherein the cruciform-shaped key has a base and a top key surface, said key having a larger cross-sectional area at its base than at its top key surface and wherein the cruciform shaped opening defined by the top surface restraining member is larger than the cross-sectional area of the top of the key base whereby the key is prevented from rotating with respect to the pivot support member to maintain each switch engaging means generally over the associated switch.

* * * * *